US007803041B2

(12) United States Patent
Gold et al.

(10) Patent No.: US 7,803,041 B2
(45) Date of Patent: Sep. 28, 2010

(54) POKER-TYPE GAME AND METHOD

(75) Inventors: Steven Terrance Gold, Las Vegas, NV (US); Jeremy Wood Zarowitz, Las Vegas, NV (US)

(73) Assignee: IGT, Reno, NV (US)

( * ) Notice: Subject to any disclaimer, the term of this patent is extended or adjusted under 35 U.S.C. 154(b) by 310 days.

(21) Appl. No.: 11/457,217

(22) Filed: Jul. 13, 2006

(65) Prior Publication Data

US 2008/0026806 A1 Jan. 31, 2008

(51) Int. Cl.
*A63F 9/00* (2006.01)

(52) U.S. Cl. ..... 463/13

(58) Field of Classification Search ..... 463/13
See application file for complete search history.

(56) References Cited

U.S. PATENT DOCUMENTS

| | | | | |
|---|---|---|---|---|
| 1,527,929 | A | 2/1925 | Simons | |
| 3,876,208 | A | 4/1975 | Wachtler et al. | |
| 3,998,462 | A | 12/1976 | Goott | |
| 4,560,161 | A * | 12/1985 | Hamano | 463/13 |
| 4,648,604 | A | 3/1987 | Horan | |
| 4,743,022 | A | 5/1988 | Wood | |
| 4,861,041 | A | 8/1989 | Jones et al. | |
| 4,948,128 | A | 8/1990 | Emery, II et al. | |
| 4,948,134 | A | 8/1990 | Suttle et al. | |
| 5,010,995 | A | 4/1991 | Okada | |
| 5,014,988 | A | 5/1991 | Mirando et al. | |
| 5,019,973 | A | 5/1991 | Wilcox et al. | |
| 5,022,653 | A | 6/1991 | Suttle et al. | |
| 5,042,818 | A | 8/1991 | Weingardt | |
| 5,046,735 | A * | 9/1991 | Hamano et al. | 434/129 |
| 5,098,107 | A | 3/1992 | Boylan et al. | |
| 5,100,137 | A | 3/1992 | Fulton | |
| 5,118,109 | A | 6/1992 | Gumina | |
| 5,118,114 | A | 6/1992 | Tucci | |
| 5,154,429 | A | 10/1992 | LeVasseur | |
| 5,158,293 | A | 10/1992 | Mullins | |
| 5,167,413 | A | 12/1992 | Fulton | |
| 5,188,363 | A | 2/1993 | Marnell, II et al. | |
| 5,248,142 | A | 9/1993 | Breeding | |
| 5,251,897 | A | 10/1993 | Fulton | |
| 5,255,915 | A | 10/1993 | Miller | |
| 5,257,789 | A | 11/1993 | LeVasseur | |
| 5,265,874 | A | 11/1993 | Dickinson et al. | |
| 5,275,400 | A | 1/1994 | Weingardt et al. | |
| 5,280,915 | A | 1/1994 | Groussman | |

(Continued)

*Primary Examiner*—Melba Bumgarner
*Assistant Examiner*—Seng Heng Lim
(74) *Attorney, Agent, or Firm*—K&L Gates LLP

(57) ABSTRACT

A poker-style game and method in which a player who is one card away from achieving a royal flush, following receipt of 0-5 replacement cards, is provided the option to receive one or more supplemental cards for no additional wager. The supplemental cards are drawn from one or more decks of cards to which the discarded cards from the first hand may have been returned. In one embodiment, a player receives a payout with a royal flush. In another embodiment, a player receives a payout if the one or more supplemental cards does not yield a royal flush, but the player's final hand is otherwise a winning hand. In another embodiment, the player may receive a payout for having four to a royal flush in the third hand, even if the player did not otherwise achieve a winning hand.

34 Claims, 5 Drawing Sheets

U.S. PATENT DOCUMENTS

| | | | | | |
|---|---|---|---|---|---|
| 5,286,023 | A | | 2/1994 | Wood | |
| 5,288,082 | A | | 2/1994 | Marquez | |
| 5,294,120 | A | | 3/1994 | Schultz | |
| 5,308,065 | A | | 5/1994 | Bridgeman et al. | |
| 5,324,041 | A | | 6/1994 | Boylan et al. | |
| 5,356,140 | A | | 10/1994 | Dabrowski et al. | |
| 5,382,025 | A | | 1/1995 | Sklansky et al. | |
| 5,411,257 | A | | 5/1995 | Fulton | |
| 5,413,353 | A | | 5/1995 | Demarest et al. | |
| 5,415,404 | A | | 5/1995 | Joshi et al. | |
| 5,437,451 | A | | 8/1995 | Fulton | |
| 5,451,054 | A | | 9/1995 | Orenstein | |
| 5,486,005 | A | | 1/1996 | Neal | |
| 5,489,101 | A | | 2/1996 | Moody | |
| 5,531,440 | A | | 7/1996 | Dabrowski et al. | |
| 5,531,441 | A | | 7/1996 | Dabrowski et al. | |
| 5,531,448 | A | | 7/1996 | Moody | |
| 5,542,669 | A | | 8/1996 | Charron et al. | |
| 5,544,892 | A | | 8/1996 | Breeding | |
| 5,570,885 | A | | 11/1996 | Ornstein | |
| 5,573,249 | A | | 11/1996 | Johnson | |
| 5,586,766 | A | | 12/1996 | Forte et al. | |
| 5,653,444 | A | | 8/1997 | Dahl | |
| 5,678,821 | A | | 10/1997 | Hedman | |
| 5,697,614 | A | | 12/1997 | Potter et al. | |
| 5,704,835 | A | | 1/1998 | Dietz, II | |
| 5,711,525 | A | | 1/1998 | Breeding | |
| 5,718,431 | A | | 2/1998 | Ornstein | |
| 5,725,216 | A | | 3/1998 | Jones | |
| 5,732,950 | A | | 3/1998 | Moody | |
| 5,755,621 | A | | 5/1998 | Marks et al. | |
| 5,772,506 | A | | 6/1998 | Marks et al. | |
| 5,775,692 | A | | 7/1998 | Watts et al. | |
| 5,779,545 | A | | 7/1998 | Berg et al. | |
| 5,785,593 | A | | 7/1998 | Wood et al. | |
| 5,788,241 | A | | 8/1998 | Ung | |
| 5,788,574 | A | | 8/1998 | Ornstein et al. | |
| 5,794,934 | A | | 8/1998 | Malcolm | |
| 5,799,946 | A | | 9/1998 | Groussman | |
| 5,816,915 | A | | 10/1998 | Kadlic | |
| 5,816,916 | A | * | 10/1998 | Moody | 463/13 |
| 5,820,460 | A | | 10/1998 | Fulton | |
| 5,823,873 | A | | 10/1998 | Moody | |
| 5,823,874 | A | | 10/1998 | Adams | |
| 5,833,536 | A | | 11/1998 | Davids et al. | |
| 5,839,730 | A | | 11/1998 | Pike | |
| 5,839,732 | A | | 11/1998 | Guidi | |
| 5,845,907 | A | | 12/1998 | Wells | |
| 5,848,932 | A | | 12/1998 | Adams | |
| 5,851,011 | A | | 12/1998 | Lott | |
| 5,851,148 | A | | 12/1998 | Brune et al. | |
| 5,868,618 | A | | 2/1999 | Netley et al. | |
| 5,868,619 | A | | 2/1999 | Wood et al. | |
| 5,882,259 | A | * | 3/1999 | Holmes et al. | 463/13 |
| 5,882,260 | A | | 3/1999 | Marks et al. | |
| 5,882,261 | A | | 3/1999 | Adams | |
| 5,897,436 | A | | 4/1999 | Singer et al. | |
| 5,902,983 | A | | 5/1999 | Crevelt et al. | |
| 5,908,353 | A | | 6/1999 | Andrews | |
| 5,911,418 | A | | 6/1999 | Adams | |
| 5,911,419 | A | | 6/1999 | Delaney et al. | |
| 5,921,550 | A | | 7/1999 | Awada | |
| 5,934,998 | A | | 8/1999 | Forte et al. | |
| 5,944,314 | A | | 8/1999 | Stavinsky | |
| 5,947,821 | A | | 9/1999 | Stone | |
| 5,947,822 | A | | 9/1999 | Weiss | |
| 5,951,012 | A | | 9/1999 | Feola | |
| 5,951,397 | A | | 9/1999 | Dickinson | |
| 5,954,335 | A | | 9/1999 | Moody | |
| 5,964,464 | A | | 10/1999 | Jones | |
| 5,967,894 | A | | 10/1999 | Kinoshita et al. | |
| 5,971,849 | A | | 10/1999 | Falciglia | |
| 5,975,529 | A | | 11/1999 | De Keller | |
| 5,976,016 | A | | 11/1999 | Moody et al. | |
| 5,984,309 | A | | 11/1999 | Santin | |
| 5,988,643 | A | | 11/1999 | Awada | |
| 5,993,316 | A | * | 11/1999 | Coyle et al. | 463/25 |
| 5,997,002 | A | | 12/1999 | Goldman | |
| 6,007,066 | A | | 12/1999 | Moody | |
| 6,007,424 | A | | 12/1999 | Evers et al. | |
| 6,012,719 | A | | 1/2000 | Webb | |
| 6,012,720 | A | | 1/2000 | Webb | |
| 6,019,374 | A | | 2/2000 | Breeding | |
| 6,033,307 | A | | 3/2000 | Vancura | |
| 6,039,648 | A | | 3/2000 | Guinn et al. | |
| 6,045,129 | A | | 4/2000 | Cooper et al. | |
| 6,048,267 | A | | 4/2000 | Wichinsky | |
| 6,050,568 | A | | 4/2000 | Hachquet | |
| 6,056,641 | A | | 5/2000 | Webb | |
| 6,059,289 | A | | 5/2000 | Vancura | |
| 6,059,658 | A | | 5/2000 | Mangano et al. | |
| 6,062,980 | A | | 5/2000 | Luciano | |
| 6,079,711 | A | | 6/2000 | Wei et al. | |
| 6,089,976 | A | | 7/2000 | Schneider et al. | |
| 6,089,977 | A | | 7/2000 | Bennett | |
| 6,093,100 | A | | 7/2000 | Singer et al. | |
| 6,098,985 | A | | 8/2000 | Moody | |
| 6,110,040 | A | | 8/2000 | Sanduski et al. | |
| 6,120,378 | A | | 9/2000 | Moody et al. | |
| 6,129,357 | A | | 10/2000 | Wichinsky | |
| 6,131,907 | A | | 10/2000 | Nucifora et al. | |
| 6,131,908 | A | | 10/2000 | Palmer | |
| 6,132,311 | A | * | 10/2000 | Williams | 463/13 |
| 6,135,453 | A | | 10/2000 | Srichayaporn | |
| 6,135,882 | A | * | 10/2000 | Kadlic | 463/13 |
| 6,135,883 | A | | 10/2000 | Hachquet | |
| 6,139,430 | A | * | 10/2000 | Huard et al. | 463/16 |
| 6,146,271 | A | * | 11/2000 | Kadlic | 463/13 |
| 6,149,157 | A | * | 11/2000 | Suan | 273/292 |
| 6,149,521 | A | | 11/2000 | Sanduski | |
| 6,155,568 | A | | 12/2000 | Franklin | |
| 6,155,925 | A | | 12/2000 | Giobbi et al. | |
| 6,159,095 | A | | 12/2000 | Frohm et al. | |
| 6,159,097 | A | | 12/2000 | Gura | |
| 6,164,652 | A | | 12/2000 | Lauretta et al. | |
| 6,173,955 | B1 | | 1/2001 | Perrie et al. | |
| 6,176,781 | B1 | | 1/2001 | Walker et al. | |
| 6,179,293 | B1 | | 1/2001 | Hedman | |
| 6,203,428 | B1 | | 3/2001 | Giobbi et al. | |
| 6,203,429 | B1 | | 3/2001 | Demar et al. | |
| 6,206,374 | B1 | | 3/2001 | Jones | |
| 6,206,780 | B1 | | 3/2001 | Awada | |
| 6,220,959 | B1 | | 4/2001 | Holmes, Jr. et al. | |
| 6,220,960 | B1 | | 4/2001 | Kryzhanovsky | |
| 6,224,055 | B1 | | 5/2001 | Walker et al. | |
| 6,227,969 | B1 | | 5/2001 | Yoseloff | |
| 6,231,442 | B1 | | 5/2001 | Mayeroff | |
| 6,237,916 | B1 | | 5/2001 | Webb | |
| 6,248,016 | B1 | | 6/2001 | Walker et al. | |
| 6,250,685 | B1 | | 6/2001 | Walker et al. | |
| 6,257,979 | B1 | | 7/2001 | Walker et al. | |
| 6,270,078 | B1 | | 8/2001 | Leone et al. | |
| 6,270,079 | B1 | | 8/2001 | Chamberlain | |
| 6,270,405 | B1 | | 8/2001 | Ferguson | |
| 6,283,855 | B1 | | 9/2001 | Bingham | |
| RE37,414 | E | | 10/2001 | Harlick | |
| 6,299,170 | B1 | | 10/2001 | Yoseloff | |
| 6,299,532 | B1 | | 10/2001 | Smith | |
| 6,305,686 | B1 | | 10/2001 | Perrie et al. | |
| 6,322,445 | B1 | | 11/2001 | Miller | |
| 6,332,614 | B1 | | 12/2001 | Hesse | |
| 6,332,839 | B2 | | 12/2001 | Walker et al. | |
| 6,334,613 | B1 | | 1/2002 | Yoseloff | |
| 6,334,614 | B1 | | 1/2002 | Breeding | |

6,336,859 B2 1/2002 Jones et al.
6,342,007 B1 * 1/2002 Wood et al. ..... 463/13
6,345,007 B1 2/2002 Kim
6,345,823 B1 2/2002 Webb
6,358,144 B1 * 3/2002 Kadlic et al. ..... 463/13
6,368,214 B1 4/2002 Luciano
6,371,851 B1 4/2002 Singer et al.
6,402,150 B1 6/2002 Jones
6,405,174 B1 6/2002 Walker et al.
6,406,023 B1 6/2002 Rowe
6,409,173 B1 6/2002 Tri
6,409,174 B1 6/2002 Demarest
6,416,407 B1 7/2002 Carrico et al.
6,428,002 B1 8/2002 Baranauskas
6,435,506 B1 8/2002 Piccoli
6,443,456 B1 9/2002 Gajor
6,461,240 B1 10/2002 Perkins
6,478,675 B1 11/2002 Awada
6,533,658 B1 3/2003 Walker et al.
6,547,242 B1 4/2003 Sugiyama et al.
6,565,432 B2 5/2003 Moody
6,595,852 B2 7/2003 Wang
6,705,943 B2 * 3/2004 Awada ..... 463/13
6,729,621 B2 5/2004 Moody
6,877,745 B1 4/2005 Walker et al.
6,923,446 B2 8/2005 Snow
6,957,774 B1 10/2005 Sung
6,994,624 B2 * 2/2006 Gold et al. ..... 463/12
7,000,921 B2 2/2006 Schultz
7,166,028 B2 1/2007 Fasbender et al.
7,297,057 B2 11/2007 Gerrard et al.
7,300,347 B1 * 11/2007 Forbes ..... 463/13
7,306,517 B1 * 12/2007 Forbes et al. ..... 463/13
7,351,139 B2 * 4/2008 Sawyer ..... 463/11
7,354,344 B2 * 4/2008 Paulsen et al. ..... 463/20
2002/0082069 A1 6/2002 Parker
2002/0086725 A1 7/2002 Fasbender et al.
2003/0073476 A1 4/2003 Friedman
2003/0107175 A1 * 6/2003 Loewenstein et al. ..... 273/292
2003/0130024 A1 7/2003 Darby
2004/0033830 A1 * 2/2004 Gold et al. ..... 463/20
2004/0043807 A1 3/2004 Pennington
2004/0198481 A1 * 10/2004 Herrington et al. ..... 463/13
2004/0229672 A1 * 11/2004 Aoki et al. ..... 463/13
2004/0242315 A1 * 12/2004 Paulsen et al. ..... 463/20
2005/0054409 A1 * 3/2005 Cannon ..... 463/13
2005/0113161 A1 5/2005 Walker et al.
2005/0130727 A1 * 6/2005 Cebulko et al. ..... 463/13
2005/0148378 A1 * 7/2005 Fasbender et al. ..... 463/13
2006/0046816 A1 * 3/2006 Walker et al. ..... 463/13
2007/0060254 A1 3/2007 Muir
2008/0064462 A1 3/2008 Gerrard
2008/0096626 A1 * 4/2008 Seelig et al. ..... 463/13
2008/0242389 A1 * 10/2008 Jackson ..... 463/13

* cited by examiner

POKER-TYPE GAME AND METHOD

CROSS-REFERENCE TO RELATED APPLICATIONS

This application is related to U.S. Pat. No. 6,994,624 issued Feb. 7, 2006 by the same named inventors, and is incorporated by reference herein.

FIELD OF THE INVENTION

This invention relates generally to poker-type games and methods, and more particularly to a poker-type game and method that provides an enhanced opportunity for a player to achieve a royal flush.

BACKGROUND OF THE INVENTION

The game of poker is widely played in a casino setting. It is played both in a traditional format, with traditional playing cards, and in an electronic format. In the electronic version, typically known as "video poker," a player makes a wager and is presented or dealt five cards. A player can choose to discard a specified number of dealt playing cards and receive replacement cards therefor. Whether or not the player's final hand qualifies for a payment is determined according to a pay table, which is generally displayed on the video poker machine itself.

The best hand that a player can achieve in classic five card poker of the type typically played on video poker machines is a royal flush. A royal flush consists of an Ace-high straight, where all of the cards have the same suit. The payout for a royal flush can be quite significant, and indeed potentially life-altering.

On the other hand, sophisticated players realize that the odds of achieving a royal flush hand can be extremely remote. Thus, a player may be reluctant to break up a winning hand (for example, having a straight or two of a kind) in an effort to achieve a royal flush. Or, where a game requires placement of an additional wager to obtain a second chance at a better hand, sophisticated players may resist this temptation, again recognizing just how difficult it is to achieve a royal flush. This reluctance can dampen player excitement.

A need therefore existed for a poker-style game and method that provides a player with an enhanced opportunity at a royal flush, after replacement cards have been drawn, without the need to place an additional wager. Preferably, the game and method should reward a player for achieving any winning hand, in the event that the final hand does not result in a royal flush. Still further, it would also be preferred for the game and method to reward a player for coming within one card of a royal flush even if the final hand does not result in any winning hand. It would also be preferred for the game and method to allow a player to purchase royal flush insurance at the time of the making of the initial wager, to qualify for the right to receive additional supplemental cards if the player is one card away from a royal flush. The present game satisfies these needs and provides other related advantages.

SUMMARY OF THE INVENTION

After a first hand of dealt cards is displayed in a video poker display, the player then decides which of the five dealt cards he or she wants to hold and which to discard. A player may discard 0-5 dealt cards from the first hand. The non-held dealt cards will be replaced with replacement cards.

The situation may be presented where a player has a five card hand that is only one card away from achieving a royal flush. This four to a royal flush hand may be from the first hand if no replacement cards are received or from the second hand after replacement cards replace the discarded dealt cards. The games and methods of the present invention address this type of situation.

Where a player, after drawing 0-5 replacement cards, is one card away from a royal flush in the second hand, software in the terminal will recognize that this situation is presented. It will prompt the player, to alert him or her of the ability to receive one or more supplemental cards in a third hand to make the royal flush.

Before display of the one or more supplemental cards for the third hand, the discarded cards may be returned to the single deck for use as supplemental cards i.e. a discarded card may become a supplemental card if drawn for the third hand.

If the player wants the one or more supplemental cards, he or she will depress the draw/deal button. In a first embodiment, this will cause display of one supplemental card from the single deck, and possibly the achievement of a royal flush in the third hand. In an alternative embodiment, this will cause display of a plurality of supplemental cards at one time from the single deck and the player may select one supplemental card from the plurality of supplemental cards to make the royal flush. In another embodiment, the player receives a plurality of supplemental cards at one time, and at least one of these supplemental cards combined with the dealt cards that said player elected to hold and said replacement cards make the royal flush.

As an additional option, payouts can be made to a player for lesser winning hands. In yet another option, a player may receive at least one supplemental card in the third hand, and if said player does not make a royal flush in the third hand, the player may be provided with at least one more option to receive at least one more supplemental card in one or more subsequent hands. The number of options may be predetermined. The player who elects to receive at least one more supplemental card for a chance at a royal flush, but who fails to draw the desired card, may receive a payout for achieving lesser winning hands after the subsequent draw(s).

In still another option, a payout may be awarded to the player who is only one card away from achieving a royal flush but does not secure any "winning hand" in the third hand. This awards the player for having four cards to a royal flush in the player's third hand.

The one or more supplemental cards may be drawn from the single deck from which the dealt and replacement cards are drawn or from a plurality of decks including the single deck or from one or more decks separate from the single deck.

Other objects, features and advantages of the present invention will become apparent from the following more detailed description, taken in conjunction with the accompanying drawings which illustrate, by way of example, the principles of the invention.

DETAILED DESCRIPTION OF THE PREFERRED EMBODIMENTS

Figure 1:
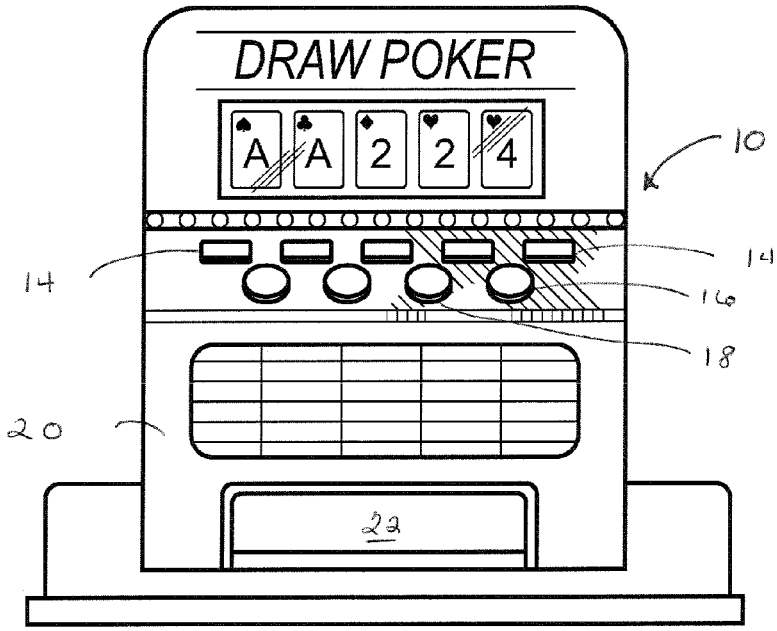
Fig. 1 (prior art)
FIG. 1 is a front view of a video poker terminal.

Referring first to FIG. 1, a video poker terminal 10 is shown. Its main features include a video display 12 (see also FIG. 2), five hold buttons 14, a draw/deal button 16, at least one bet button 18, a pay table 20, and a coin output 22. The terminal 10 should also have a payment receiver (not shown), through which coins, cash, payment cards, or the like may be inserted for purposes of placing a wager.

Generally, in a prior art poker game, play is initiated by the insertion of a payment into the payment receiver. A player will typically then depress the bet button 18 and/or the deal/draw button 16 in order to receive a display of a first hand of five dealt cards from a single deck of playing cards. While a single deck of playing cards is traditionally 52 cards, it is to be appreciated that as used herein, a "single deck" may include other than 52 cards (e.g. Joker's Wild). (In some games, more than one bet button 18 is provided, with for example one bet button allowing a player to bet one amount, and another allowing a player to bet a larger amount). After a first hand of dealt cards is displayed in the video display 12, the player then decides which of the five dealt cards he or she wants to hold and which to discard. A player may discard 0-5 dealt cards from the first hand. A player indicates a hold selection for each card that is to be held by depressing the hold button 14 located directly below a dealt card 24 that is to be held, e.g. If the player elects to hold all five cards, the player will depress the hold buttons 14 corresponding to each of the five dealt cards. (If a player changes his or her mind, the hold button 14 can be depressed a second time to cancel the selection.)

Once the player completes his or her hold selections, the player will depress the draw/deal button 16. This will cause the non-held dealt cards 24 to be replaced with replacement cards. Conversely, if the player wants to discard all five dealt cards, the player would press none of the hold buttons before depressing the draw/deal button 16.

Figure 2:
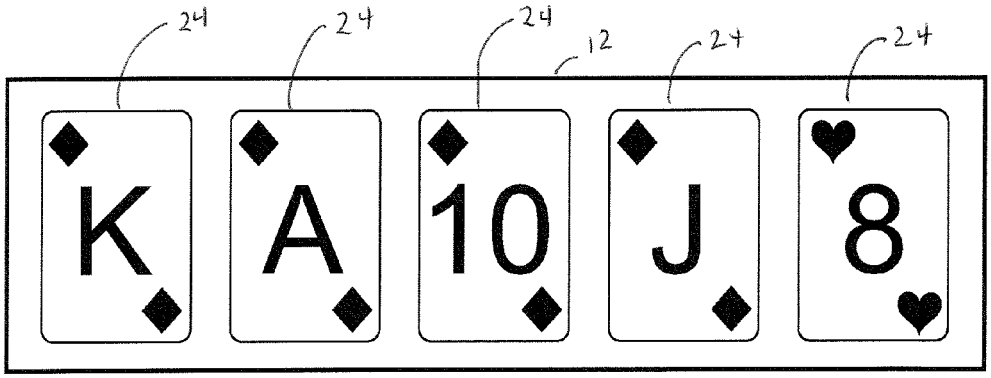
Fig. 2 (prior art)
FIG. 2 is a front view of a video poker screen, showing a poker hand that is one card away from a royal flush.

Referring now to FIG. 2, the situation is presented where a player has a five card hand that is only one card (e.g. the Queen of Diamonds) away from achieving a royal flush. This four to a royal flush hand may be from the first hand if no replacement cards are received or from the second hand after replacement cards replace the discarded dealt cards. The games and methods of the present invention address this type of situation.

Figure 3:
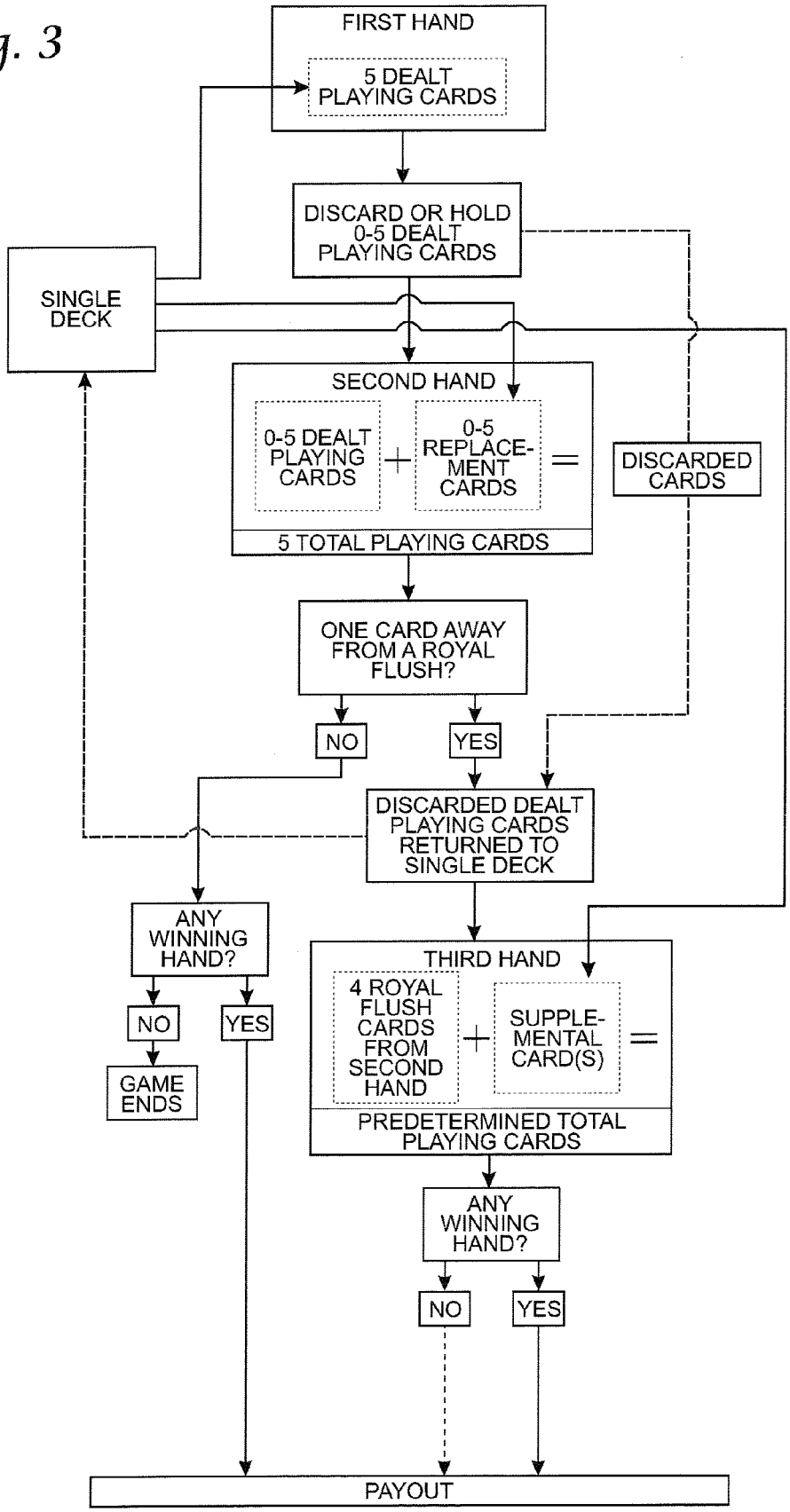
FIG. 3 is a flow chart, illustrating a number of methods of play of the present invention.
Figure 6:
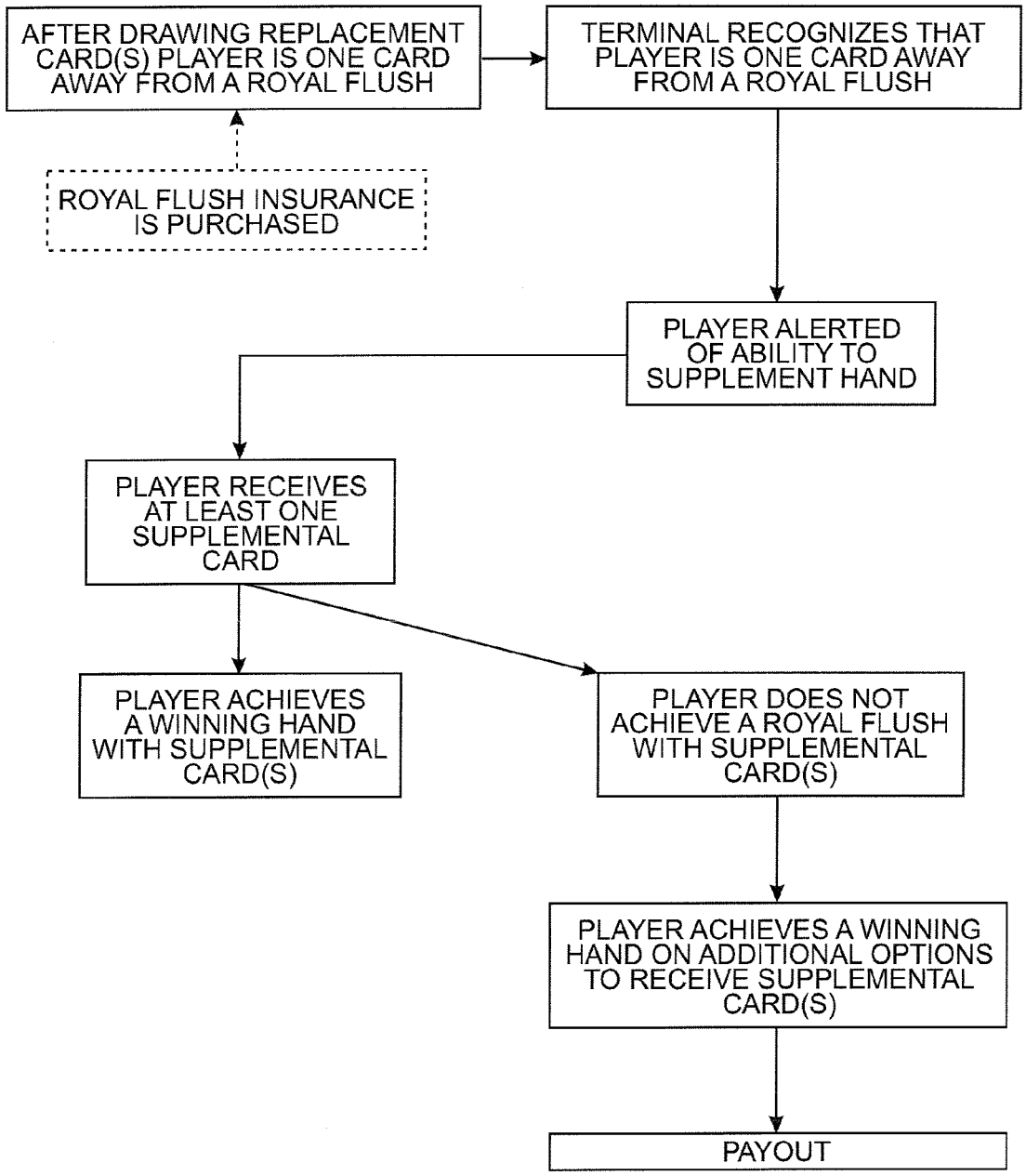
FIG. 6 is another flow chart, illustrating a number of methods of play of the present invention.

Referring now to FIGS. 3 and 6, methods of the game of the present invention are illustrated. Where a player, after drawing 0-5 replacement cards, is one card away from a royal flush in the second hand, software in the terminal 10 will recognize that this situation is presented. It will prompt the player, to alert him or her of the ability to receive one or more supplemental cards in a third hand to make the royal flush.

Before display of the one or more supplemental cards for the third hand, the discarded cards may be returned to the single deck for use as supplemental cards i.e. a discarded card may become a supplemental card if drawn for the third hand. This addresses concerns of a player who has previously discarded cards but may want at least one of the discarded cards to make a winning hand when combined with the replacement cards. For example, the player may be dealt the Ace of spades, the King of spades, the Ace of hearts, the 2 of diamonds, and the 3 of diamonds in the first hand. The player holds the two Aces and discards the other three cards. The player receives three replacement cards for those discarded cards: the Queen of spades, the Jack of spades, and the 10 of spades to complete the second hand. The player is only one card away from a Royal Flush, but has already discarded the missing card, the King of spades. This return step causes the King of spades, the 2 of diamonds and the 3 of diamonds to be returned to the single deck before the one or more supplemental cards are drawn thereby increasing the chance of a player achieving a royal flush in the third hand.

Figure 4:
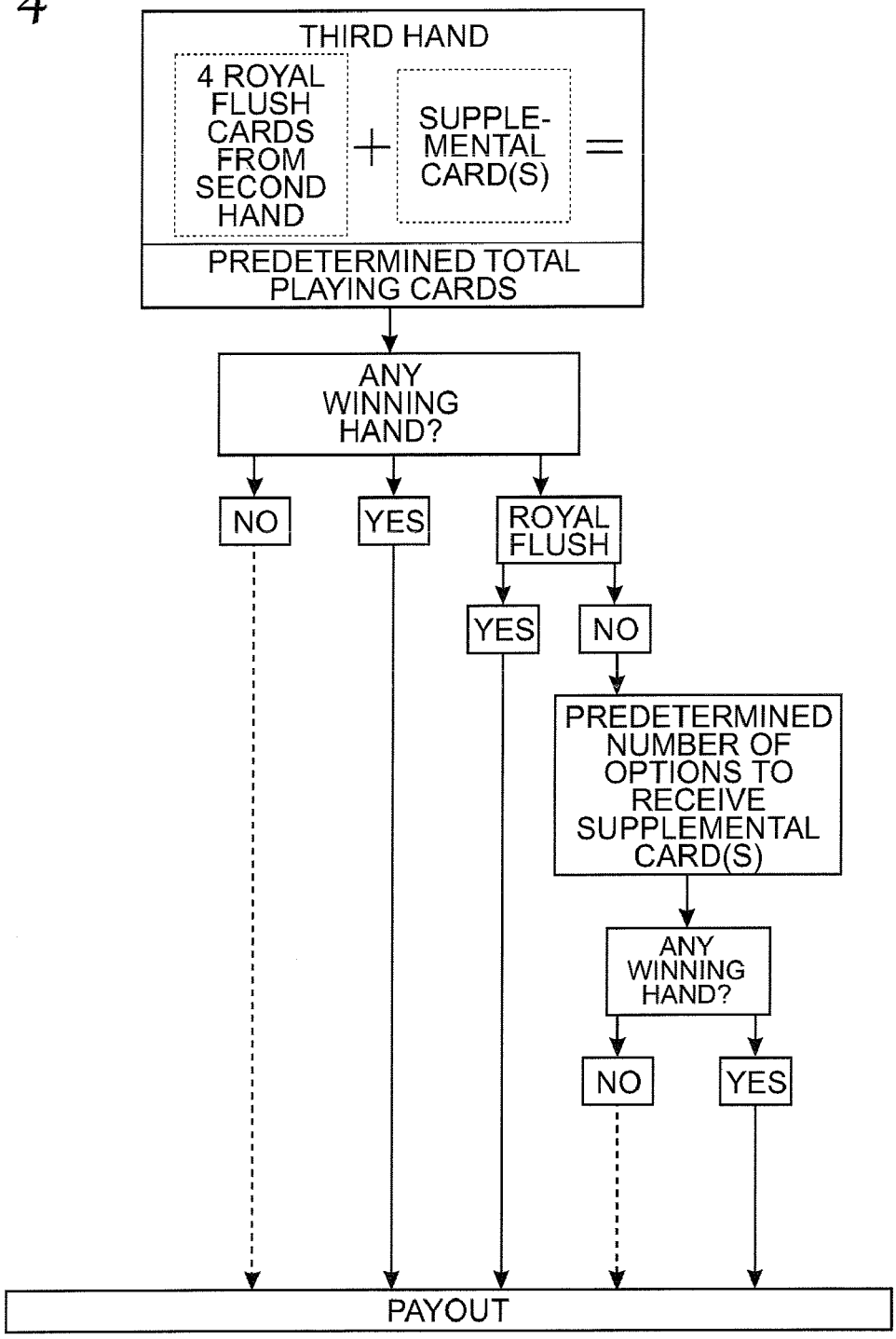
FIG. 4 is a flow chart, illustrating the possible options for receiving a payout after the third hand.

If the player wants the one or more supplemental cards, he or she will depress the draw/deal button 16. In a first embodiment, this will cause display of one supplemental card from the single deck, and possibly the achievement of a royal flush in the third hand. In an alternative embodiment, this will cause display of a plurality of supplemental cards at one time from the single deck and the player may select one supplemental card from the plurality of supplemental cards to make the royal flush. In another embodiment, the player receives a plurality of supplemental cards at one time, and at least one of these supplemental cards combined with the dealt cards that said player elected to hold and said replacement cards (i.e. the cards in the second hand) make the royal flush. No additional wager should be requested from the player. As shown in FIGS. 3, 4 and 6, payouts may be made to the player for achieving the royal flush.

As an additional option, payouts can be made to a player for lesser winning hands (i.e. other than a royal flush). As used herein, a "winning hand" is selected from the group consisting of a royal flush or lesser winning hands. A "winning hand" may also be any predefined combination of cards understood by the player to be a "winning hand." For example, it can be provided that a payout will be made for a combination of predetermined random cards.

In yet another option, a player may receive at least one supplemental card in the third hand, and if said player does not make a royal flush in the third hand, the player may be provided with at least one more option to receive at least one more supplemental card in one or more subsequent hands. The number of options may be predetermined. The player who elects to receive at least one more supplemental card for a chance at a royal flush, but who fails to draw the desired card, may receive a payout for achieving lesser winning hands after the subsequent draw(s). If the player has a winning third hand according to the pay table 20, a payout may be made through the coin output 22.

In still another option, as indicated by dotted lines in FIGS. 3 and 4, a payout may be awarded to the player who is only one card away from achieving a royal flush but does not secure any "winning hand". This awards the player for having four cards to a royal flush in the player's third hand.

Royal flush insurance may be purchased before the inception of play, by making an additional payment at the beginning of the game. The purpose of such payment would be to secure to the player the later right to one or more options to receive supplemental cards, in the event that a player has four cards to a royal flush.

These additional options have the effect of encouraging players, from the inception of the game, to know that their chances of winning are not solely dependent on achieving the elusive royal flush hand. Again, this rewards a player's risk taking behavior, and increases player excitement.

Figure 5:
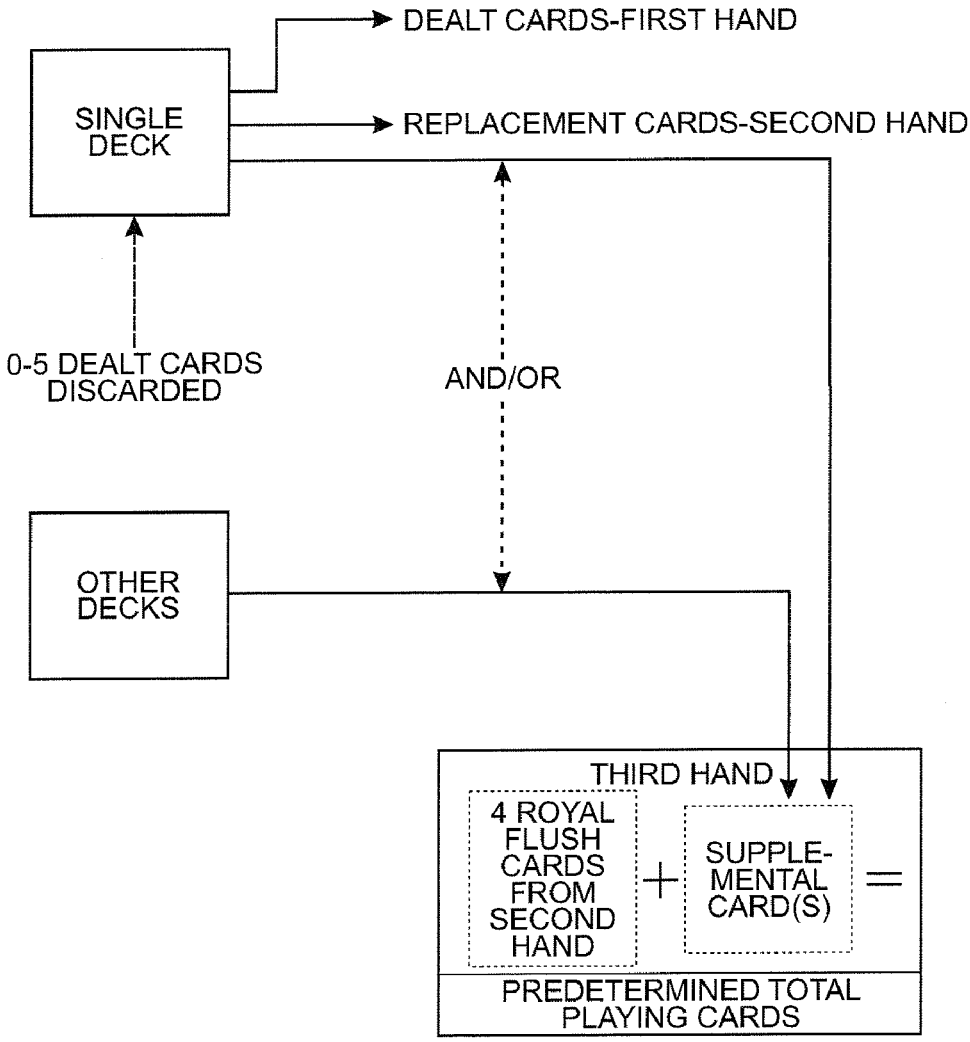
FIG. 5 is a flow chart, illustrating the source of the playing cards in each of the first, second and third hands.

Although the one or more supplemental cards have been described as drawn from the single deck from which the dealt and replacement cards are drawn, it is to be appreciated that the one or more supplemental cards may instead be drawn from a plurality of decks including the single deck or from one or more decks separate from the single deck as shown in FIG. 5. If the supplemental card(s) are drawn from deck(s) other than the single deck, the discarded cards may not be returned to the single deck and thus may not be drawn as supplemental card(s).

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

We claim:

1. A gaming system comprising:

a display device;

an input device;

a processor; and a memory device which stores a plurality of instructions, which when executed by the processor, cause the processor to operate with the display device and the input device, for each play of a poker-style game, to:

(a) display to a player five playing cards dealt for the poker-style game from a single deck of playing cards;

(b) permit said player to hold a desired number of said dealt five playing cards;

(c) permit said player to draw replacement playing cards for each dealt playing card that said player elects not to hold from the playing cards remaining in the single deck; and (d) if said player is only one playing card away from achieving a royal flush poker hand:

(i) return each of said dealt playing cards that said player elected not to hold to the single deck; and (ii) provide said player with at least one option to receive a winning poker hand by:

(A) displaying to said player an indication of a plurality of supplemental playing cards from said playing cards in the single deck, said plurality of supplemental playing cards being less than a quantity of playing cards remaining in the single deck, at least one of said plurality of supplemental playing cards being randomly determined, and ensuring another one of said plurality of supplemental playing cards being a playing card which when combined with said player's replacement playing cards and the playing cards said player elected to hold, form the royal flush poker hand; and (B) selecting one of said plurality of supplemental playing cards to try to form the royal flush poker hand without requiring said player to place any additional wagers.

2. The gaming system of claim 1, wherein when executed by the processor, said plurality of instructions cause the processor to enable said player select one of said supplemental playing cards.

3. The gaming system of claim 1, wherein if the selected supplemental playing card, said player's replacement playing cards, and the playing cards said player elected to hold do not form the royal flush poker hand, said plurality of instructions cause the processor to repeat step (d)(ii) at least once.

4. The gaming system of claim 3, wherein the plurality of instructions cause the processor to repeat step (d)(ii) a predetermined quantity of times.

5. The gaming system of claim 1, wherein said player receives the plurality supplemental playing cards from the single deck and from at least one additional deck.

6. The gaming system of claim 1, wherein when executed by the processor, said plurality of instructions cause the processor to provide a payout to said player who is only one playing card away from said royal flush poker hand if, after receiving said selected supplemental playing card, said player has not achieved said royal flush poker hand.

7. The gaming system of claim 3, wherein when executed by the processor, said plurality of instructions cause the processor to provide a payout to said player who is only one playing card away from said royal flush poker hand if, after receiving said plurality of supplemental playing cards, said player has not achieved said royal flush poker hand.

8. The gaming system of claim 1, wherein when executed by the processor, said plurality of instructions cause the processor to enable said player to make a payment, prior to said display of said five playing cards, to obtain a right to later receive additional supplemental playing cards in the event that said player is only one playing card away from achieving said royal flush poker hand.

9. A gaming system comprising:

a display device;

an input device;

a processor; and a memory device which stores a plurality of instructions, which when executed by the processor, cause the processor to operate with the display device and the input device, for each play of a poker-style game, to:

(a) display to a player five playing cards dealt for said poker-style game from a single deck of playing cards;

(b) permit said player to hold a desired number of said dealt five playing cards;

(c) permit said player to draw replacement playing cards for each dealt playing card that said player elects not to hold from the playing cards remaining in the single deck; and (d) if said player is only one playing card away from achieving a royal flush:

(i) return each of said dealt playing cards that said player elected not to hold to the single deck; and (ii) provide said player with at least one option to receive a winning, poker hand by:

(A) displaying to said player an indication of a plurality of supplemental playing cards from the playing cards in the single deck, said plurality of supplemental playing cards being less than a quantity of playing cards remaining in the single deck, at least one of said plurality of supplemental playing cards being randomly determined, and ensuring another one of said plurality of supplemental playing cards being a playing card which when combined with said player's replacement playing cards and the playing cards said player elected to hold, form the royal flush poker hand; and (B) selecting one of said plurality of supplemental playing cards to try to form the royal flush poker hand without requiring said player to place any additional wagers.

10. The gaming system of claim 9, wherein if the selected supplemental playing card, said player's replacement playing cards, and the playing cards said player elected to hold do not form the royal flush poker hand, said plurality of instructions cause the processor to repeat step (d)(ii) at least once.

11. The gaming system of claim 10, wherein the plurality of instructions cause the processor to repeat step (d)(ii) a predetermined quantity of times.

12. A gaming system comprising:

a display device;

an input device;

a processor; and a memory device which stores a plurality of instructions, which when executed by the processor, cause the processor to operate with the display device and the input device, for each play of a poker-style game, to:

(a) display to a player five playing cards dealt for the poker-style game from a single deck of playing cards;

(b) permit said player to hold a desired number of said dealt five playing cards;

(c) permit said player to draw replacement playing cards for each dealt playing card that said player elects not to hold from the playing cards remaining in the single deck; and (d) if said player is only one playing card away from achieving a royal flush, provide said player with at least one option to receive a winning poker hand by:

(i) displaying to said player an indication of a plurality of supplemental playing cards from a plurality of playing cards in a plurality of decks of playing cards, said plurality of supplemental playing cards being less than a quantity of playing cards remaining in the single deck of playing cards, at least one of said plurality of supplemental playing cards being randomly determined, and ensuring another one of said plurality of supplemental playing cards being a playing card which when combined with said player's replacement playing cards and the playing cards said player elected to hold, form the royal flush poker hand; and (ii) selecting one of said plurality of supplemental playing cards to try to form the royal flush poker hand without requiring said player to place any additional wagers.

13. The gaming system of claim 12, wherein when executed by the processor, said plurality of instructions cause the processor to enable said player pick one of said plurality of supplemental playing cards.

14. The gaming system of claim 12, wherein if the selected supplemental playing card, said player's replacement playing cards, and the playing cards said player elected to hold do not form the royal flush poker hand, said plurality of instructions cause the processor to repeat step (d) at least once.

15. The gaming system of claim 14, wherein the plurality of instructions cause the processor to repeat step (d) a predetermined quantity of times.

16. The gaming system of claim 12, wherein when executed by the processor, said plurality of instructions cause the processor to return each of said dealt playing cards that said player elected not to hold to the single deck before said plurality of instructions cause the processor to operate with the display device to provide said player at least one option to receive the plurality of supplemental playing cards from the plurality of said playing cards in the plurality of decks of playing cards.

17. A method for operating a gaming device, said method comprising, for each play of a poker-style game:

(a) displaying to a player five playing cards dealt for said poker-style game from a single deck of playing cards on a video display device;

(b) causing the video display device to display said five dealt playing cards;

(c) permitting said player to hold a desired number of said dealt five playing cards;

(d) permitting said player to draw replacement playing cards for each dealt playing card that said player elects not to hold from the playing cards remaining in the single deck; and (e) if said player is only one playing card away from achieving a royal flush;

(i) returning each of said dealt playing cards that said player elected not to hold to the single deck; and (ii) providing said player with at least one option to receive a winning poker hand by:

(A) displaying to said player an indication of a plurality of supplemental playing cards from a plurality of playing cards in the single deck, said plurality of supplemental playing cards being less than a quantity of playing cards remaining in the single deck of playing cards, at least one of said plurality of supplemental playing cards being randomly determined, and ensuring another one of said plurality of supplemental playing cards being a playing card which when combined with said player's replacement playing cards and the playing cards said player elected to hold, form the royal flush poker hand; and (B) selecting one of said plurality of supplemental playing cards to try to form the royal flush poker hand without requiring said player to place any additional wagers.

18. The method of claim 17, wherein said player picks one of said supplemental playing cards.

19. The method of claim 17, wherein if the selected supplemental playing card, said player's replacement playing cards, and the playing cards said player elected to hold do not form the royal flush poker hand, said method includes repeating step (e)(ii) at least once.

20. The method of claim 19, which includes repeating step (e)(ii) a predetermined quantity of times.

21. The method of claim 17, which includes providing said player the plurality of supplemental playing cards from the single deck and from at least one additional deck.

22. A method for operating a gaming system, said method comprising, for each play of a poker-style game:

(a) displaying to a player five playing cards dealt for said poker-style game from a single deck of playing cards on a video display device;

(b) causing said video display device to display said five playing cards to said player;

(c) permitting said player to hold a desired number of said dealt five playing cards;

(d) permitting said player to draw replacement playing cards for each dealt playing card that said player elects not to hold from the playing cards remaining in the single deck; and (e) if said player is only one playing card away from achieving a royal flush, provide said player with at least one option to receive a winning poker hand by:

(A) displaying to said player an indication of a plurality of supplemental playing cards from a plurality of playing cards in a plurality of decks of playing cards, said plurality of supplemental playing cards being less than a quantity of playing cards remaining in the single deck of playing cards, at least one of said plurality of supplemental playing cards being randomly determined, and ensuring another one of said plurality of supplemental playing cards being a playing card which when combined with and the royal flush is formed from one of said plurality of randomly determined playing cards, said player's replacement playing cards and the playing cards said player elected to hold, form the royal flush poker hand; and (B) selecting one of said plurality of supplemental playing cards to try to form the royal flush poker hand without requiring said player to place any additional wagers.

23. The method of claim 22, wherein the plurality of decks of playing cards includes the single deck and each of said dealt playing cards that said player elected not to hold are returned to the single deck before providing said player with at least one option to receive the plurality of supplemental playing cards from the plurality of playing cards of the plurality of decks of playing cards.

24. A gaming system comprising:

at least one display device;

at least one input device;

at least one processor; and at least one memory device which stores a plurality of instructions, which when executed by the at least one processor, cause the at least one processor to operate with the at least one display device and the at least one input device to:

(a) enable a player to place a wager;

(b) randomly select and display a plurality of playing cards from at least one deck of playing cards, said displayed plurality of playing cards forming a first poker hand;

(c) enable the player to designate zero, one or a plurality of said displayed playing cards in said first poker hand to discard;

(d) for each of said displayed playing cards the player designated to discard, randomly select and display another one of said playing cards from said at least one deck of playing cards to replace each of said discarded playing cards such that said playing cards randomly selected to replace said discarded playing cards and any non-discarded playing cards form a second poker hand; and (e) if all but one of said displayed playing cards in said second poker hand and an additional designated playing card would form a royal flush poker hand, without requiring the player to place any additional wager:

(i) return each of said displayed playing cards the player designated to discard to said at least one deck of playing cards, (ii) display an indication of a plurality of supplemental playing cards, said plurality of supplemental playing cards being less than a quantity of playing cards remaining in the at least one deck of playing cards, at least one of said plurality of supplemental playing cards being randomly determined, and ensuring another one of said plurality of supplemental playing cards being said additional designated playing card that forms said royal flush poker hand (iii) select and display one of said plurality of supplemental playing cards, and (iv) provide the player an award associated with said poker hand if said selected and displayed supplemental playing card is said additional designated playing card.

25. The gaming system of claim 24, wherein when executed by the processor, said plurality of instructions cause the processor to provide the player an award for any winning outcome associated with said first poker hand.

26. The gaming system of claim 24, wherein when executed by the processor, said plurality of instructions cause the processor to operate with the display device to select each of said displayed playing cards from a plurality of decks of playing cards.

27. The gaming system of claim 24, wherein when executed by the processor, said plurality of instructions cause the processor to enable the player to pick at least one of said plurality of supplemental playing cards.

28. The gaming system of claim 24, wherein when executed by the processor, said plurality of instructions cause the processor to repeat (e) at least once.

29. The gaming system of claim 24, wherein when executed by the processor, said plurality of instructions cause the processor to enable the player to make a side wager prior to displaying said plurality of playing cards which form said first poker hand, wherein if the player places said side wager and if all but one of said displayed playing cards in said second poker hand and an additional designated playing card would form said poker hand associated with a designated winning outcome, said plurality of instructions cause the processor to operate with the display device to display said indication of said plurality of supplemental playing cards from said at least one deck of playing cards.

30. A gaming system comprising:

at least one display device;

at least one input device;

at least one processor; and at least one memory device which stores a plurality of instructions, which when executed by the at least one processor, cause the at least one processor to operate with the at least one display device and the at least one input device to:

(a) enable a player to place a wager;

(b) randomly select and display a plurality of playing cards from at least one deck of playing cards, said displayed plurality of playing cards forming a first poker hand;

(c) enable the player to designate zero, one or a plurality of said displayed playing cards in said first poker hand to discard;

(d) for each of said playing cards the player designated to discard, randomly select and display another one of said playing cards from said at least one deck of playing cards to replace each of said discarded playing cards such that said playing cards randomly selected to replace said discarded playing cards and any non-discarded playing cards form a second poker hand; and (e) if all but one of said displayed playing cards in said second poker hand and an additional designated playing card would form a royal flush poker hand, without requiring the player to place any additional wager:

(i) display an indication of a plurality of supplemental playing cards, said plurality of supplemental playing cards being less than a quantity of playing cards remaining in the at least one deck of playing cards, at least one of said plurality of supplemental playing cards being randomly determined, and ensuring another one of said plurality of supplemental playing cards being said additional designated playing card;

(ii) select and display one of said plurality of supplemental playing cards; and (iii) provide the player an award associated with said poker hand if said selected and displayed supplemental playing card is said additional designated playing card.

31. The gaming system of claim 30, wherein when executed by the processor, said plurality of instructions cause the processor to operate with the display device to select each of said playing cards from a plurality of decks of playing cards.

32. The gaming system of claim 30, wherein when executed by the processor, said plurality of instructions cause the processor to enable the player to pick at least one of said plurality of supplemental playing cards.

33. The gaming system of claim 30, wherein when executed by the processor, said plurality of instructions cause the processor to repeat (e) at least once if said selected supplemental playing card is not said additional designated playing card.

34. The gaming system of claim 30, wherein when executed by the processor, said plurality of instructions cause the processor to enable the player to make a side wager prior to displaying said plurality of playing cards which form said first poker hand, wherein if the player places said side wager and if all but one of said displayed playing cards in said second poker hand and an additional designated playing card would form said poker hand associated with a designated winning outcome, said plurality of instructions cause the processor to operate with the display device to display said indication of said plurality of supplemental playing cards from said at least one deck of playing cards.

* * * * *

UNITED STATES PATENT AND TRADEMARK OFFICE

CERTIFICATE OF CORRECTION

PATENT NO. : 7,803,041 B2
APPLICATION NO. : 11/457217
DATED : September 28, 2010
INVENTOR(S) : Gold et al.

It is certified that error appears in the above-identified patent and that said Letters Patent is hereby corrected as shown below:

In Claim 9, Column 6, Line 39, replace "winning, poker" with --winning poker--.

In Claim 22, Column 8, Lines 59 to 61, replace "which when combined with and the royal flush is formed from one of said plurality of randomly determined playing cards, said player's" with --which when combined with said player's--.

In Claim 24, Column 9, Line 48, after "hand" insert a --,--.

In Claim 24, Column 9, Lines 51 to 52, replace "said poker hand" with --said royal flush poker hand--.

In Claim 30, Column 10, Lines 53 to 54, replace "said poker hand" with --said royal flush poker hand--.

Signed and Sealed this

Fourteenth Day of December, 2010

David J. Kappos

David J. Kappos
*Director of the United States Patent and Trademark Office*